US006928986B2

(12) United States Patent
Niethammer et al.

(10) Patent No.: US 6,928,986 B2
(45) Date of Patent: Aug. 16, 2005

(54) FUEL INJECTOR WITH PIEZOELECTRIC ACTUATOR AND METHOD OF USE

(75) Inventors: Bernd Niethammer, Blythewood, SC (US); Johann Warga, Bietigheim/Bissingen (DE); Jason Lin, Naperville, IL (US)

(73) Assignee: Siemens Diesel Systems Technology VDO, Blythewood, SC (US)

( * ) Notice: Subject to any disclaimer, the term of this patent is extended or adjusted under 35 U.S.C. 154(b) by 0 days.

(21) Appl. No.: 10/745,997

(22) Filed: Dec. 29, 2003

(65) Prior Publication Data

US 2005/0145221 A1 Jul. 7, 2005

(51) Int. Cl.[7] ..... F02M 55/00
(52) U.S. Cl. ..... 123/467; 239/96
(58) Field of Search ..... 123/467, 498; 239/88–96

(56) References Cited

U.S. PATENT DOCUMENTS

| | | | |
|---|---|---|---|
| 3,464,627 | A | 9/1969 | Huber |
| 3,481,542 | A | 12/1969 | Huber |
| 3,913,537 | A | 10/1975 | Ziesche et al. |
| 4,000,852 | A | 1/1977 | Martin |
| 4,033,507 | A | 7/1977 | Fromel et al. |
| 4,046,112 | A | 9/1977 | Deckard |
| 4,129,253 | A | 12/1978 | Bader, Jr. et al. |
| 4,170,974 | A | 10/1979 | Kopse et al. |
| 4,187,987 | A | 2/1980 | Raue |
| 4,345,717 | A | 8/1982 | Clark et al. |
| 4,417,201 | A | 11/1983 | Reddy |
| 4,440,132 | A | 4/1984 | Terada et al. |
| 4,524,743 | A | 6/1985 | McAuliffe, Jr. et al. |
| 4,545,352 | A | 10/1985 | Jourde et al. |
| 4,546,739 | A | 10/1985 | Nakajima et al. |
| 4,618,095 | A | 10/1986 | Spoolstra |
| 4,674,688 | A | 6/1987 | Kanesaka |
| 4,676,478 | A | 6/1987 | Kiuchi |
| 4,712,528 | A | 12/1987 | Schaffitz |
| 4,784,101 | A | 11/1988 | Iwanaga et al. |
| 4,858,439 | A | 8/1989 | Sawada et al. |
| 4,909,440 | A | 3/1990 | Mitsuyasu et al. |
| 4,911,127 | A | 3/1990 | Perr |
| 4,917,352 | A | 4/1990 | Hauet et al. |

(Continued)

FOREIGN PATENT DOCUMENTS

DE 41 18 237 A1 12/1991

(Continued)

*Primary Examiner*—Thomas Moulis
(74) *Attorney, Agent, or Firm*—McGuireWoods LLP

(57) ABSTRACT

A fuel injector having a piezoelectric actuator. A needle valve is mounted in the injector body and has an opening hydraulic surface substantially surrounded by a high-pressure fuel line in fluid communication with a high-pressure fuel chamber. A control piston partly defines a piston control chamber, which is in fluid communication with the opening hydraulic surface and the high-pressure fuel chamber. The piezoelectric actuator is activated between an off position and an on position for positioning a control valve into an open position or a closed position. A high-pressure fuel condition is maintained in the piston control chamber by fuel supplied from the high-pressure fuel chamber and independent of any actuation of the control valve. In a low pressure fuel condition, a force on the opening hydraulic surface of the needle valve member is greater than the downward force on the closing hydraulic surface thereby opening the needle valve member for producing an injection event.

70 Claims, 9 Drawing Sheets

U.S. PATENT DOCUMENTS

| | | | |
|---|---|---|---|
| 4,979,479 | A | 12/1990 | Furukawa |
| 4,984,549 | A | 1/1991 | Mesenich |
| 5,004,154 | A | 4/1991 | Yoshida et al. |
| 5,014,671 | A | 5/1991 | Taue et al. |
| 5,018,501 | A | 5/1991 | Watanabe et al. |
| 5,057,734 | A | 10/1991 | Tsuzuki et al. |
| 5,080,079 | A | 1/1992 | Yoshida et al. |
| 5,088,647 | A | 2/1992 | Yoshida et al. |
| 5,090,620 | A | 2/1992 | Yoshida et al. |
| 5,094,215 | A | 3/1992 | Gustafson |
| 5,109,824 | A | 5/1992 | Okamoto et al. |
| 5,121,730 | A | 6/1992 | Ausman et al. |
| 5,150,684 | A | 9/1992 | Jun |
| 5,156,132 | A | 10/1992 | Iwanaga |
| 5,168,855 | A | 12/1992 | Stone |
| 5,168,857 | A | 12/1992 | Hickey |
| 5,169,066 | A | 12/1992 | Ricco et al. |
| 5,176,115 | A | 1/1993 | Campion |
| 5,183,019 | A | 2/1993 | Suhara |
| 5,186,151 | A | 2/1993 | Schwerdt et al. |
| 5,191,867 | A | 3/1993 | Glassey |
| 5,213,083 | A | 5/1993 | Glassey |
| 5,217,204 | A | 6/1993 | Maier et al. |
| 5,237,968 | A | 8/1993 | Miller et al. |
| 5,241,935 | A | 9/1993 | Beck et al. |
| 5,245,970 | A | 9/1993 | Iwaszkiewicz et al. |
| RE34,527 | E | 2/1994 | Yoshida et al. |
| 5,287,839 | A | 2/1994 | Kondou et al. |
| RE34,591 | E | 4/1994 | Yoshida et al. |
| 5,329,908 | A | 7/1994 | Tarr et al. |
| 5,335,852 | A | 8/1994 | Muntean et al. |
| 5,335,861 | A | 8/1994 | Matusaka |
| 5,357,912 | A | 10/1994 | Barnes et al. |
| 5,361,014 | A | 11/1994 | Antone et al. |
| 5,390,048 | A | 2/1995 | Miyatake et al. |
| 5,429,309 | A | 7/1995 | Stockner |
| 5,452,858 | A | 9/1995 | Tsuzuki et al. |
| 5,460,329 | A | 10/1995 | Sturman |
| 5,463,996 | A | 11/1995 | Maley et al. |
| 5,472,142 | A | 12/1995 | Iwanaga |
| 5,477,828 | A | 12/1995 | Barnes |
| 5,477,831 | A | 12/1995 | Akaki et al. |
| 5,479,902 | A | 1/1996 | Wirbeleit et al. |
| 5,482,213 | A | 1/1996 | Matsusaka et al. |
| 5,492,098 | A | 2/1996 | Hafner et al. |
| 5,535,723 | A | 7/1996 | Gibson et al. |
| 5,551,398 | A | 9/1996 | Gibson et al. |
| 5,605,134 | A | 2/1997 | Martin |
| 5,628,293 | A | 5/1997 | Gibson et al. |
| 5,630,550 | A | 5/1997 | Kurishige et al. |
| 5,669,355 | A | 9/1997 | Gibson et al. |
| 5,673,669 | A | 10/1997 | Maley et al. |
| 5,697,342 | A | 12/1997 | Anderson et al. |
| 5,743,470 | A | 4/1998 | Schlaf et al. |
| 5,779,149 | A | 7/1998 | Hayes, Jr. |
| 5,803,361 | A | 9/1998 | Horiuchi et al. |
| 5,803,370 | A | 9/1998 | Heinz et al. |
| 5,845,852 | A | 12/1998 | Waldman et al. |
| 5,884,848 | A | 3/1999 | Crofts et al. |
| 5,954,033 | A | 9/1999 | Moncelle |
| 6,062,489 | A | 5/2000 | Tokumaru |
| 6,273,346 | B1 | 8/2001 | Estevenon et al. |
| 6,274,967 | B1 | 8/2001 | Zumstrull et al. |
| 6,299,074 | B1 | 10/2001 | Cooke |
| 6,367,453 | B1 * | 4/2002 | Igashira et al. ..... 123/467 |
| 6,553,967 | B2 * | 4/2003 | Mahr ..... 123/467 |
| 6,655,355 | B2 * | 12/2003 | Kropp et al. ..... 123/467 |
| 6,684,857 | B2 * | 2/2004 | Boecking ..... 123/467 |
| 6,810,857 | B2 * | 11/2004 | Boehland et al. ..... 123/467 |

FOREIGN PATENT DOCUMENTS

| | | |
|---|---|---|
| GB | 2 078 870 A | 1/1982 |
| JP | 2-218859 | 8/1990 |
| JP | 3-290054 | 12/1991 |

* cited by examiner

FUEL INJECTOR WITH PIEZOELECTRIC ACTUATOR AND METHOD OF USE

BACKGROUND OF THE INVENTION

1. Field of the Invention

The invention generally relates to a fuel injector and, more particularly, to a fuel injector having a piezoelectric actuator that provides improved rate shaping qualities and improved multiple control of the fuel injection events of the fuel injector and a method of use thereof.

2. Background Description

There are many types of fuel injectors designed to inject fuel into a combustion chamber of an engine. For example, fuel injectors may be mechanically, electrically or hydraulically controlled in order to inject fuel into the combustion chamber of the engine. In the hydraulically actuated systems, a control valve body may be provided with two, three or four way valve systems, each having grooves or orifices which allow fluid communication between working ports, high pressure ports and venting or drain ports of the control valve body of the fuel injector and the inlet area. The working fluid is typically engine oil or other types of suitable hydraulic fluid that is capable of providing a pressure within the fuel injector in order to begin the process of injecting fuel into the combustion chamber.

In current designs, a control valve controls the flow of working fluid from the oil rail to the intensifier chamber and hence the intensifier piston (i.e., fill position), as well as controls the flow of the working fluid from the intensifier chamber to ambient (i.e., drain position). During an injection cycle, fuel in a high-pressure chamber is placed under pressure by the intensifier piston. The high-pressure fuel will flow to the nozzle assembly where it will overcome spring forces and other hydraulic forces to lift the needle for injection of fuel into a combustion chamber.

However, simply using this type of fuel injector and the accompanying multiple process may not be adequate to reduce emissions or provide varying quantities of fuel (e.g., pilot quantity of fuel) during the combustion process. Accordingly, many types of fuel injectors have been designed which attempt to reduce emissions, from providing a pilot quantity of fuel and multiple injections to other controls. In one type of system, a piezoelectric actuator is used to control an injection cycle. For example, a piezoelectric actuator is operable to control the fuel pressure within a control chamber defined, in part, by a surface of the valve needle of the injector. This is referred to as a parasitic escape of fuel. Further, during injection, pressure waves may be transmitted along the fuel passages and lines which, in turn, may give rise to undesirable needle movement during injection and may be of sufficient magnitude to cause secondary injections. The large control chamber may cause this shortcoming.

In other known systems, additional valves, such as three way poppet valve are required in order to provide a positive fuel pressure within the control chamber. The three-way valve, in general, will control the injection cycle of the fuel injector. Being more specific, the three way valve will provide (i) fuel into the control chamber in order provide a pressure therein and maintain the needle valve in a closed position, (ii) drain the fuel from the control chamber to a drain supply line and (iii) provide fluid communication between the control chamber and the high pressure fuel line. In this manner, control of the needle valve can be maintained. These three way valves are typically spring loaded and controlled by an actuator. In this same type of system, an electronically controlled valve is required in order to allow the fuel to enter the high-pressure fuel chamber from a low-pressure fuel supply line. This electronically controlled valve is typically in the open position to allow the fuel to enter the high-pressure fuel chamber, but also allows for "bleeding" (i.e., fuel to flow from the high-pressure chamber to the low pressure supply line). To close this valve, a controller or solenoid closes the valve so that the intensifier piston can provide a high-pressure environment which, initially, will not open the needle valve due to various other counter forces such as, for example, the fuel pressure within the control chamber.

The invention is directed to overcoming one or more of the problems as set forth above.

SUMMARY OF THE INVENTION

In a first aspect of the invention, a fuel injector includes an injector body defining a nozzle outlet and a high-pressure fuel chamber. A needle valve member is mounted in the injector body and has an opening hydraulic surface substantially surrounded by a high pressure fuel line which is in fluid communication with the high-pressure fuel chamber. The needle valve member is movable between an open position and a closed position with respect to the nozzle outlet. A piezoelectric actuator is activated between an off position and an on position for positioning a control valve into one of an open position and a closed position. A control piston has a closing hydraulic surface and is positioned in mechanical communication with the needle valve member. A piston control chamber is positioned between the control valve and the closing hydraulic surface of the control piston. The piston control chamber is in fluid communication with the control valve and the high-pressure fuel chamber via throttles. A high-pressure fuel condition is maintained in the piston control chamber by fuel supplied directly from the high-pressure fuel chamber and independent of any actuation of the control valve. The high-pressure fuel condition results in a downward force acting on the closing hydraulic surface of the control piston. A pressure loss fuel condition is generated within the piston control chamber by activation of the piezoelectric actuator which moves the control valve to the open position for releasing fuel. A force on the opening hydraulic surface of the needle valve member is greater than the downward force on the closing hydraulic surface of the control piston, in the pressure loss fuel condition, thereby opening the needle valve member for producing an injection event.

In another aspect of the invention, a fuel injector includes an injector body, a control valve and an intensifier mechanism positioned within the injector body and set in motion by actuation of the control valve. A high-pressure fuel chamber is located within the injector body which provides a high-pressure fuel condition in response to an activation of the intensifier mechanism. An independently controlled hydraulically actuated fuel supply valve supplies fuel to the high-pressure fuel chamber. A high-pressure supply line is in fluid communication with the high-pressure fuel chamber and a needle valve member is mounted in the injector body and has an opening hydraulic surface surrounded at least partially by the high-pressure fuel line. A piezoelectric actuator is mounted in the injector body and independently controlled to be moved between an off position and an on position for controlling movement of a controllable valve between an open position and a closed position. A control piston has a closing hydraulic surface and is mechanically coupled to the needle valve member. A piston control chamber is in fluid communication with the high-pressure fuel line and defined by an upper end of the control piston and an interior wall of the injector body.

In still another aspect of the invention, a fuel injector includes an injector body having a high-pressure fuel chamber and a needle valve member with a hydraulic surface. A high-pressure fuel line is in fluid communication with the high-pressure fuel chamber and at least partially surrounding the hydraulic surface of the needle valve member. A control chamber is in direct fluid communication with the high-pressure fuel chamber. A controllable valve generates a high-pressure fuel condition in the high-pressure fuel chamber, the high-pressure fuel line and the control chamber. A needle valve member is mounted in the injector body and has an opening hydraulic surface at least partially surrounded by the high-pressure fuel line. A piezoelectric actuator is mounted in the injector body and is actuated between an off position and an on position by actuation of an electrically actuated controller. A pressure release valve is positionable in an open position and a closed position by actuation of the piezoelectric actuator. A first fuel line is in fluid communication with the control chamber and the high-pressure fuel chamber, the first fuel line having a first diameter. A second fuel line is in fluid communication with the pressure release valve and the control chamber and has a second diameter which is larger than the first diameter of the first fuel line. A high-pressure fuel condition is maintained in the control chamber by a fuel pressure which is generated in the high-pressure fuel chamber and independent of an initial actuation of the electronically actuated control. A low-pressure fuel condition is generated within the control chamber when the pressure release valve is in the open position.

In still another aspect of the invention, an internal combustion engine includes a combustion chamber having intake and exhaust valves and a lubrication system for lubricating components associated with the combustion chamber. A rail line and a fuel injector communicating with the combustion chamber is also provided. The fuel injector includes an injector body having an intensifier chamber in fluid communication with the rail line and an intensifier piston movable within the intensifier chamber. An independently controllable hydraulic valve supplies fuel to the high-pressure fuel chamber. A high-pressure fuel line is in fluid communication with the high-pressure fuel chamber. A needle valve member has a hydraulic surface at least partially surrounded by the high-pressure fuel line. A control chamber and a first fuel line fluidly coupled between the high-pressure chamber and the control chamber is also provided. An independently hydraulically actuated valve controls the intensifier piston. A piezoelectric actuator is mounted in the injector body and is activated between an off position and an on position by actuation of an electrically actuated controller. A pressure release valve is positionable in an open position and a closed position by actuation of the piezoelectric actuator. A second fuel line is fluidly coupled between the pressure release valve and the control chamber. A high-pressure fuel condition is provided in the control chamber independently by a fuel pressure which is generated in the high-pressure fuel chamber. A low-pressure fuel condition is generated within the control chamber when the pressure release valve is in the open position.

In yet another aspect of the invention, a method of controlling fuel injection events of a fuel injector is provided. The method includes the steps of:

(i) hydraulically actuating a valve to provide low pressure fuel to a high-pressure fuel chamber within the fuel injector;

(ii) hydraulically actuating a valve to provide working fluid to an intensifier chamber within the fuel injector, the working fluid acting on an intensifier piston in the intensifier chamber;

(iii) generating a high-pressure fuel condition, upon actuation of the valve, in the high-pressure chamber, and a control chamber and a high-pressure both fluidly coupled with the high-pressure chamber; and (iv) independently activating a two way pressure release valve to drain fuel in the control chamber and thereby create a low pressure condition in the control chamber.

The low pressure fuel condition in the control chamber creates a pressure differential in the control chamber and the high-pressure fuel line such that fuel in the high-pressure fuel line is able to exert an upward force on a hydraulic surface of a needle valve to raise the needle valve to begin an injection event.

BRIEF DESCRIPTION OF THE DRAWINGS

The foregoing and other objects, aspects and advantages will be better understood from the following detailed description of a preferred embodiment of the invention with reference to the drawings, in which.

DETAILED DESCRIPTION OF A PREFERRED EMBODIMENT OF THE INVENTION

The invention is directed to a fuel injector having a piezoelectric actuator. In the embodiments of the invention, high-pressure fuel can be easily reached (e.g., 2200 bar and more are easily achieved) with superior rate shaping performance to the injection event. Additionally, injection quantity can be higher for both for "large" diesel engines (possible>0.5 liter/cylinder) and smaller engines with very precise control. By using the fuel injector of the invention, pilot and post injections are now possible within all injection pressures with obvious noise reduction compared to conventional systems. Additionally, rail dynamics are dampened and reduced through switch on of the intensifier valve, and cold performance will be increased with the use of diesel fuel for control of the injector.

EMBODIMENTS OF THE OIL ACTIVATED FUEL INJECTOR OF THE INVENTION

Figure 1:
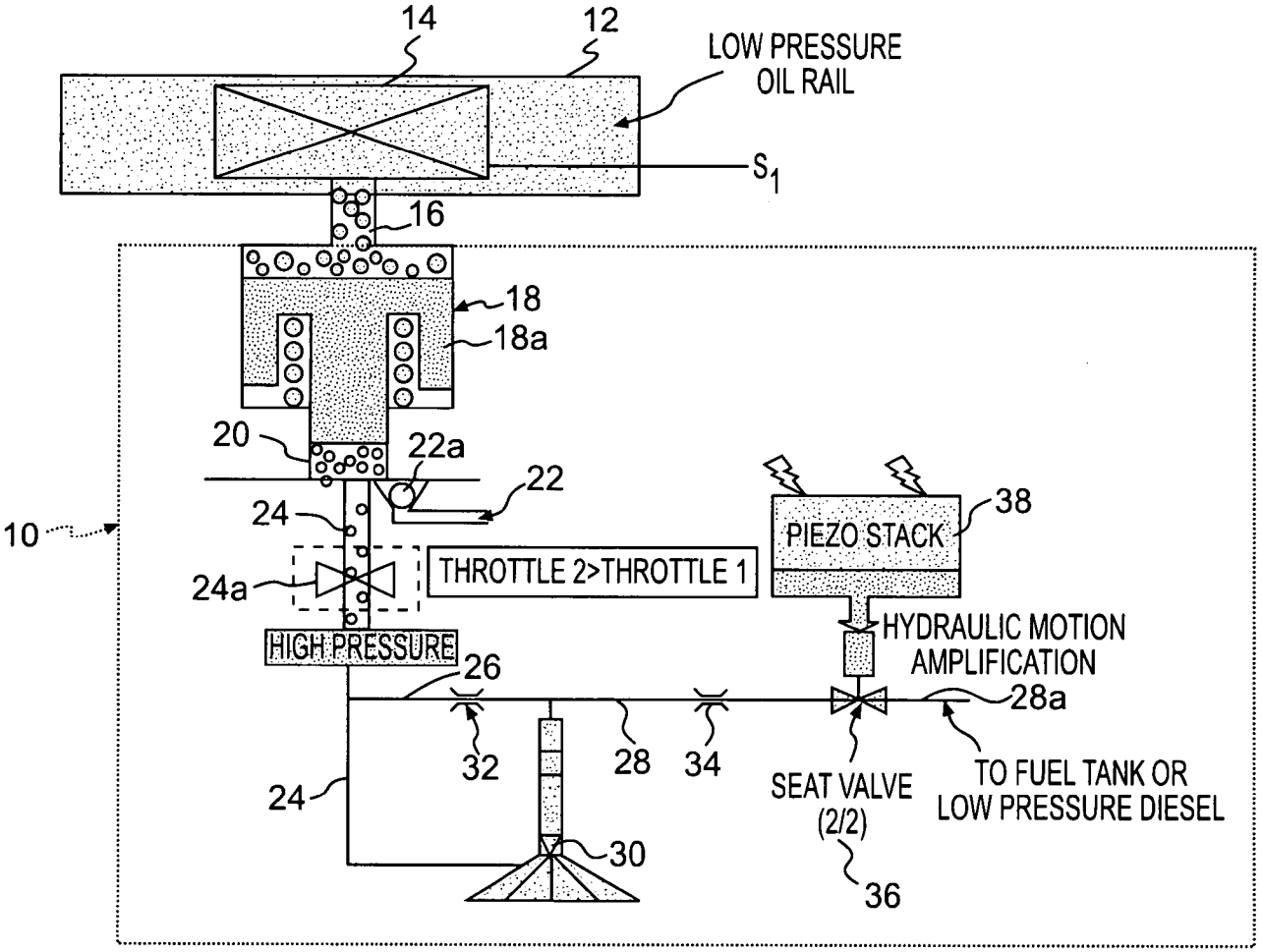
FIG. 1 shows a schematic view of an embodiment of a fuel injector with a piezoelectric actuator of the invention.

Referring now to FIG. 1, a schematic view of a first embodiment of the fuel injector of the invention. In this schematic view, the fuel injector is depicted generally as reference numeral 10. A low-pressure rail 12 includes a control valve 14, e.g., a 3/2 way valve, in fluid communication with the fuel injector 10 by a hydraulic connection rail 16. The control valve 14 is actuated by solenoid, $S_1$. The low-pressure rail 14 provides oil to the fuel injector 10 and more specifically to an intensifier chamber 18 of the fuel injector 10.

The intensifier chamber 18 includes a piston and plunger assembly 18*a* in communication with a high-pressure fuel chamber 20. The piston and plunger assembly is in mechanical communication with a spring 19 for biasing the assembly toward the rail 14. A fuel supply line 22 is also in fluid communication with the high-pressure fuel chamber 20 via a hydraulically actuated one way ball valve 22*a*. And, a high-pressure fuel line 24 is in fluid communication with a first fluid line 26 and a second fluid line 28. The high-pressure fuel line 24 extends to a nozzle assembly 30 (also referred to as a needle valve member). The one way valve 22*a* allows fuel to enter the high-pressure fuel chamber 20, but prevents bleeding or any back flow. In view of the above discussion, it should now be recognized by those of ordinary skill in the art that the high-pressure fuel chamber 20 supplies the high-pressure fuel throughout the injector of the invention, i.e., the fluid lines 24, 26 and 28 as well as to the nozzle assembly, via the activation of the solenoid, $S_1$. That is, the control valve 14, activated by the solenoid, $S_1$, is used activate the high pressure within the fuel injector.

The first fluid line 26 includes a first throttle 32 and the second fluid line 28 includes a second throttle 34. In embodiments, a control valve 36 such as, for example, a 2/2 seat valve, is positioned between the second throttle 34, a piezoelectric actuator 38 (piezoelectric stack) and a drain or pressure release line 28. The pressure release line 28 is in fluidly communication with a fuel tank of low-pressure diesel reservoir. The piezoelectric actuator 38 controls the opening and closing of the control valve 36, as discussed in more detail below, and thus allows for a drain condition in a control chamber to thus provide for a pressure differential within the injector. But, it should be understood that the control valve 14 activates the high pressure throughout the injector of the invention and is mainly responsible for the control of the fuel injector of the invention. More specifically, the control valve 14 controls the activation of the intensifier piston 18 which, in turn, results in the high pressure fuel conditions within the fuel injector.

Still referring to FIG. 1, the diameter of the second throttle 34 is preferably larger than the diameter of the first throttle 32. This configuration allows a large flow to generate a pressure loss upon activation of the piezoelectric actuator 34. By way of illustration, upon an applied voltage to the piezoelectric actuator 38, the control valve 36 will open allowing high-pressure fuel to flow through the larger throttle 34 and into the pressure release line 28*a*. This will create a low-pressure condition in a piston control chamber (shown in FIG. 4). In this way, the pressure within the high-pressure fuel line 24 will exceed a downward force exerted on a closing hydraulic surface of a control piston which is mechanically coupled to the nozzle assembly 30. This will allow the needle to rise and an injection event to occur within a combustion chamber. (See, FIGS. 3 and 4.) In the closed position, (i.e., no voltage applied to the piezoelectric actuator), the fuel pressure in the piston control chamber is approximately equal to the fuel pressure within the high-pressure fuel line 24. In this mode of operation, the needle will remain in a closed position and injection events will not occur.

Figure 2:
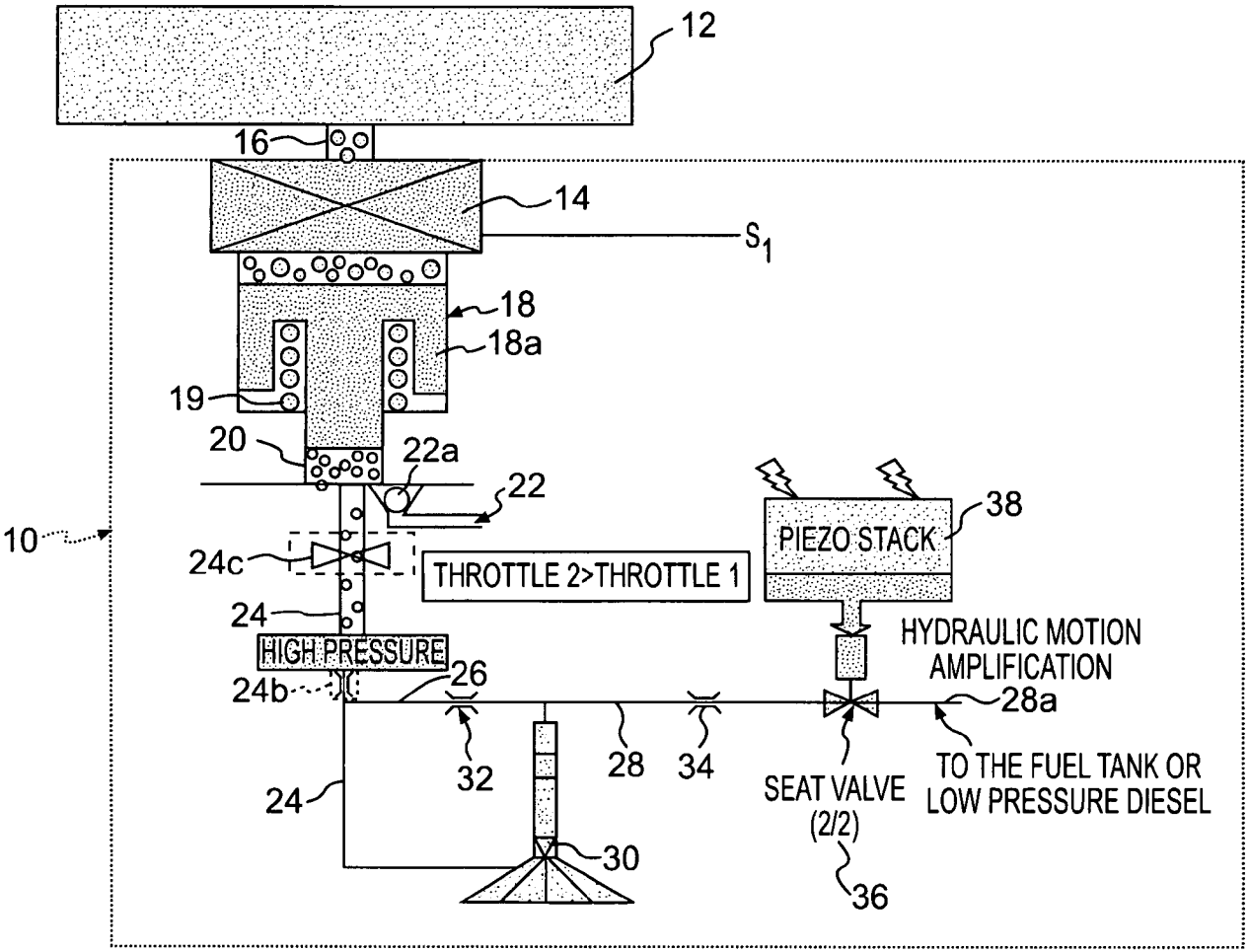
FIG. 2 shows a schematic view of another embodiment of a fuel injector with a piezoelectric actuator of the invention.

FIG. 2 is another embodiment of the invention. In this embodiment, the control valve 14 is situated in the hydraulic connection rail 16. The remaining features are substantially identical to that of FIG. 1. That is, for example, the control valve 14 is actuated by the solenoid $S_1$ and the piezoelectric actuator 38 controls the control valve 36. Also, it remains that the control valve 14 of the invention controls the high-pressure condition within the fuel injector and injection events of the fuel injector. The piezoelectric actuator 38 controls the control valve 36, on the other hand, and provides for a pressure differential (i.e., a pressure loss) to occur in the piston control chamber by allowing the control valve 36 to open to the pressure release line 28*a*.

During the dynamic pressurization of the high-pressure port in the injector, a pre-opening of the nozzle may occur due to the arrangement of the throttles; that is, it may take some time until the volume is filled equally with pressure since the fluid is compressible, especially for higher pressures. To prevent this from happening, different methods may be used. By way of example, a larger volume may pass the first throttle 32 on the fuel line 24 down to the nozzle such that it will take longer to reach the required pressure. In still another variation, a throttle 24*b* may be may be placed in line 24 to build-up the pressure in line 28, or a check valve 24*c* (FIG. 2) may be placed between the chamber 20 and the first throttle 32 and line 28 to maintain the pressure within line 28 for the next injection event.

Figure 3A:
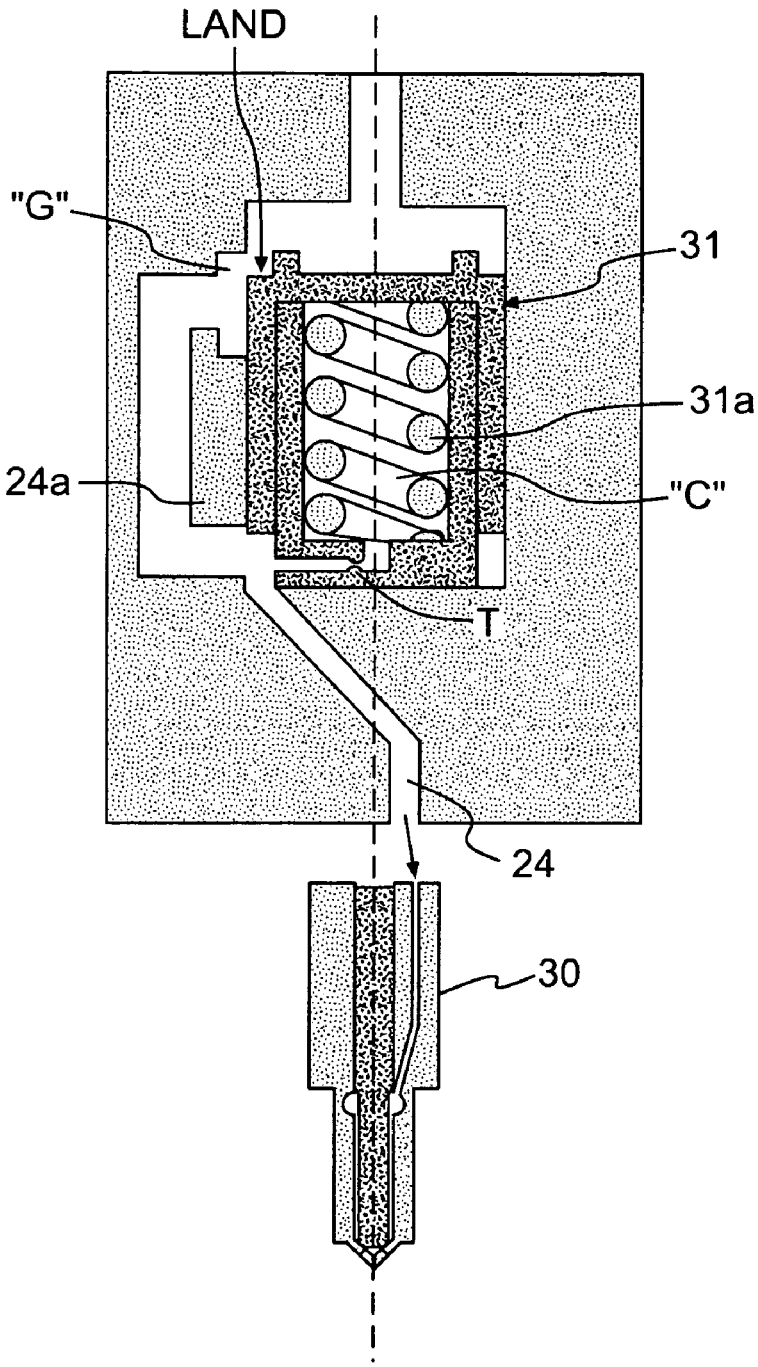
FIGS. 3*a*–3*d* show enlarged schematic portions of aspects of the fuel injector of the invention.
Figure 3B:
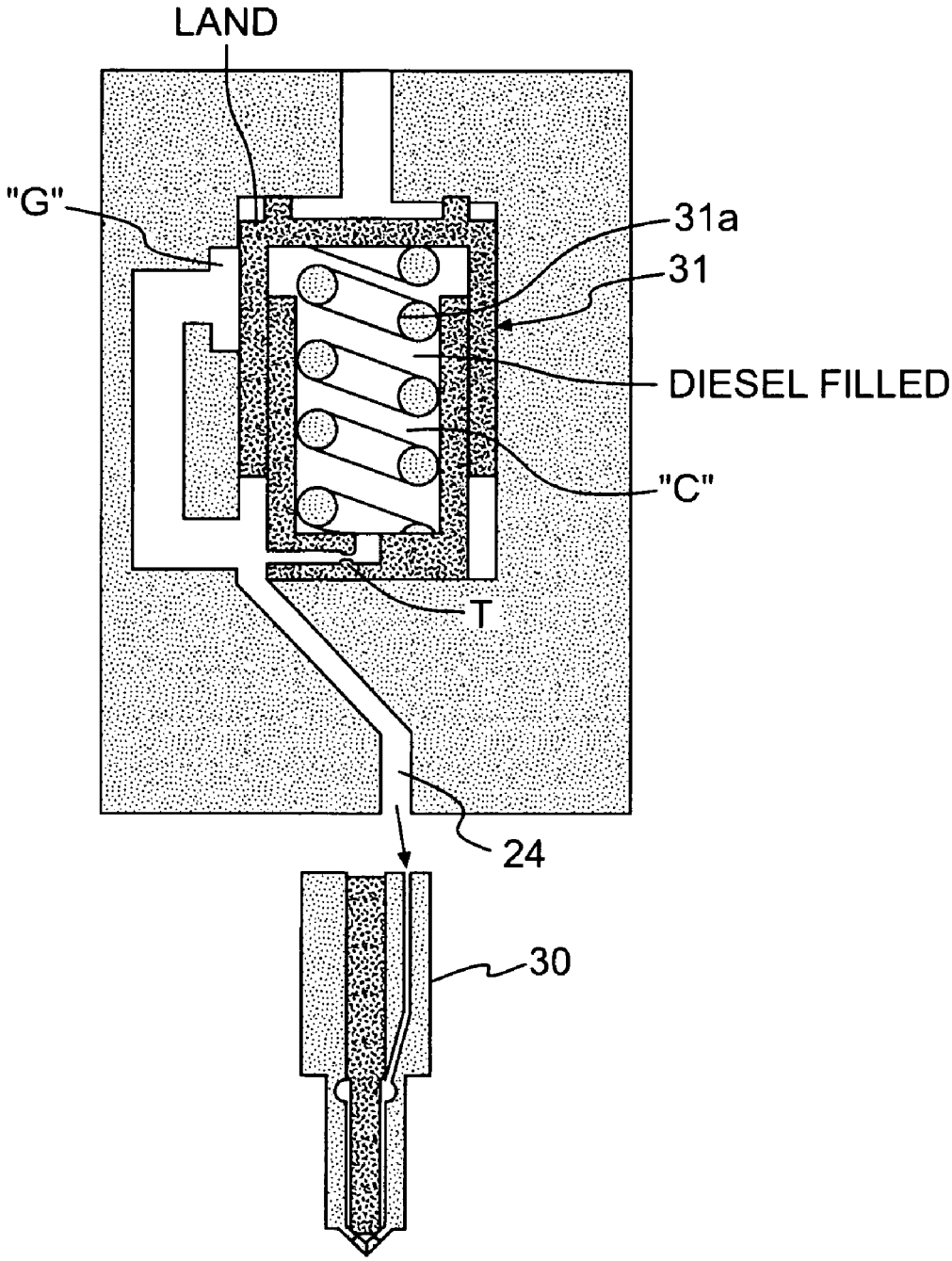

In another variation, FIG. 3*a* shows an enlarged highly schematic view of a portion of the fuel injector of the invention. In this view, FIG. 3*a* show a delay valve 24*a* in line 24 that is used to ensure that the pressure build-up behind the nozzle 30 happens faster. This delay valve 24*a* may be a check plate or delay piston. In the embodiment of FIG. 3*a*, the valve includes a telescoping valve assembly generally denoted as reference numeral 31. At a lower portion of the valve assembly 31 is a timing throttle "T" which is in communication with the high-pressure fuel line 24. A spring 31*a* is positioned in a chamber "C" defined by the upper and lower portion of the valve assembly. The spring 31*a* biases the upper and lower portion of the valve assembly 31 in a closed position. Fuel may reside within the chamber "C". The delay valve 31 additionally includes a groove "G" and the upper portion of the valve assembly includes a communicating land. For the time delay to be generated, the land needs to open with relation to the groove "G".

In FIG. 3*a*, the land of the valve assembly 31 is in communication with the groove "C". In this state, the timing throttle "T" as well as the high pressure control chamber 20 is in fluid communication with the high-pressure fuel line 24, i.e., when the rail 14 provides oil to the intensifier chamber 18. For the time delay to be generated, the land is open with relation to the groove "G". In this state, the upper and lower portion of the valve assembly 31 are biased together, compressing the spring 31*a*. Fuel within the chamber between the upper and lower portion of the valve assembly 31 will be forced through the timing throttle "T" into the high-pressure fuel line 24. in FIG. 3*b*, the land closes the groove "G".

Figure 3C:
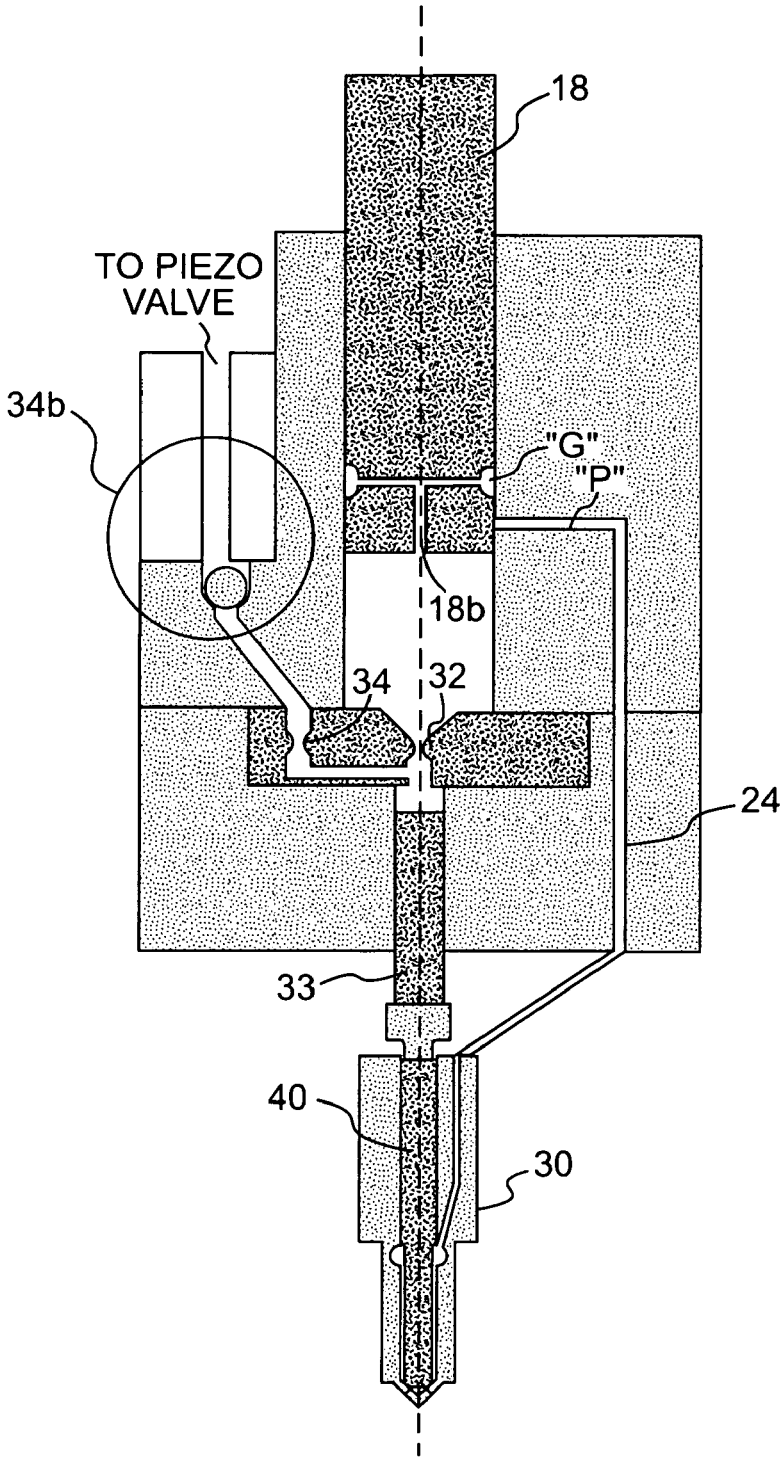

In still another embodiment, FIG. 3*c* shows another enlarged highly schematic view of a portion of the fuel injector of the invention. In this embodiment, a spill bore 18*b* in the intensifier chamber 18 may be used to delay the pressurization in line 24. A groove "G" is in fluid communication with the spill bore 18*b*. The pressure will first generate in the high-pressure fuel chamber 20 and will then push the control piston 33 downward to hold the needle in the downward position. Then, the port "P" will open to line 24 via the groove "G" in fluid communication with the spill bore 18*b*. To keep the pressure inside the passage to the piezoelectric valve, the check valve 34*b* will reduce the additional volume to fill. Also, any leakage along the plunger 18 is smaller than the flow through the throttle 32. In still further embodiments, the check valve 34*b* may be positioned behind the second throttle 34 in order to maintain the pressure and the volume in the line 24 for the next injection event.

Figure 3D:
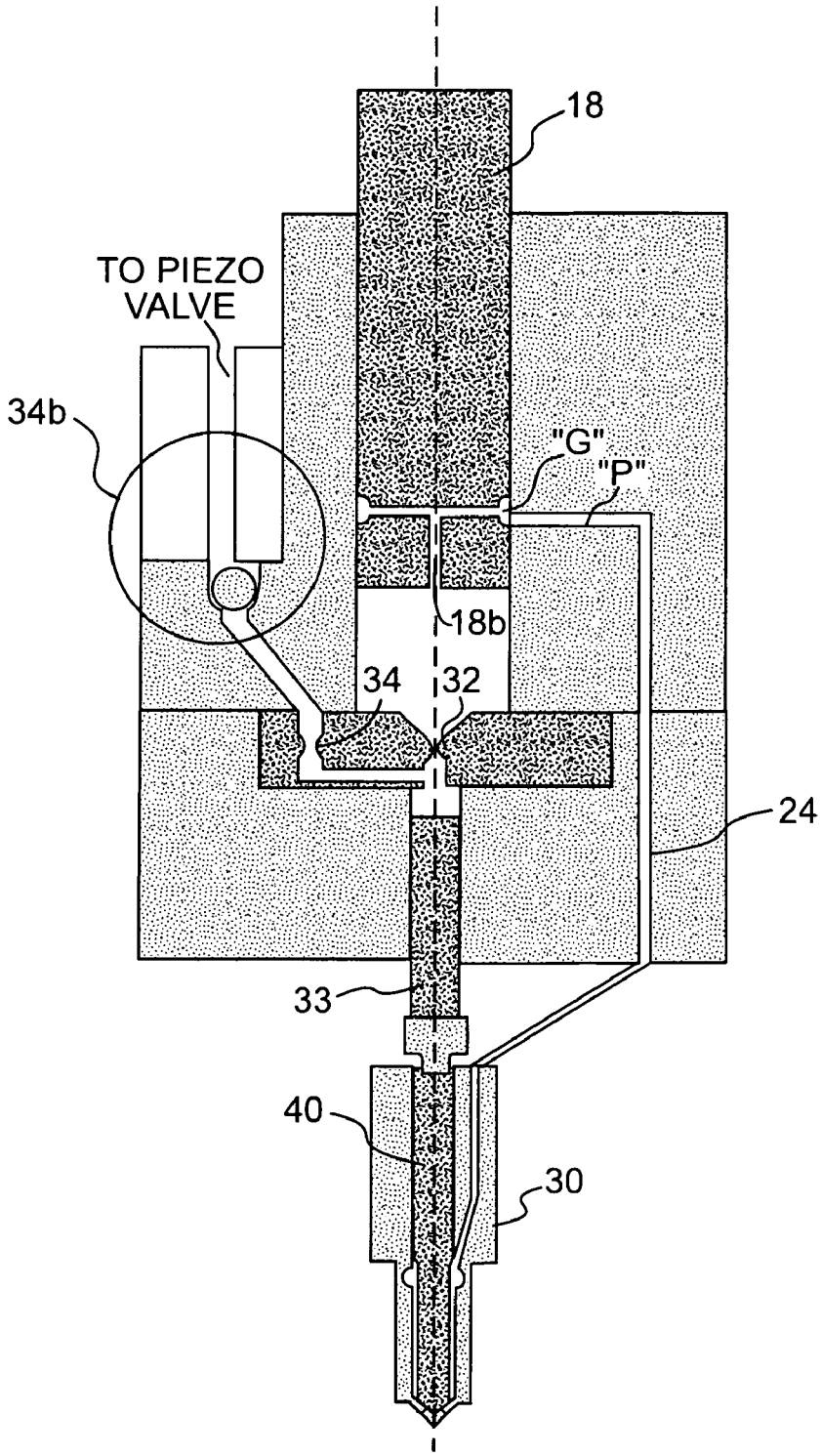

In FIG. 3*d*, the spill bore 18*b* is in fluid communication with the port "P" via the "G". In this state, the fuel in the high-pressure fuel chamber 20 can communicate with the high-pressure fuel line 24 during activation of the injector, i.e., when the rail 14 provides oil to the intensifier chamber 18. In FIG. 3*c*, the plunger is moved upward, after an injection event, and the spill bore 18*b* is no longer in fluid communication with the port "P" and the high-pressure fuel line 24. The spill bore is used to delay pressurization in the high-pressure fuel line.

Figure 4:
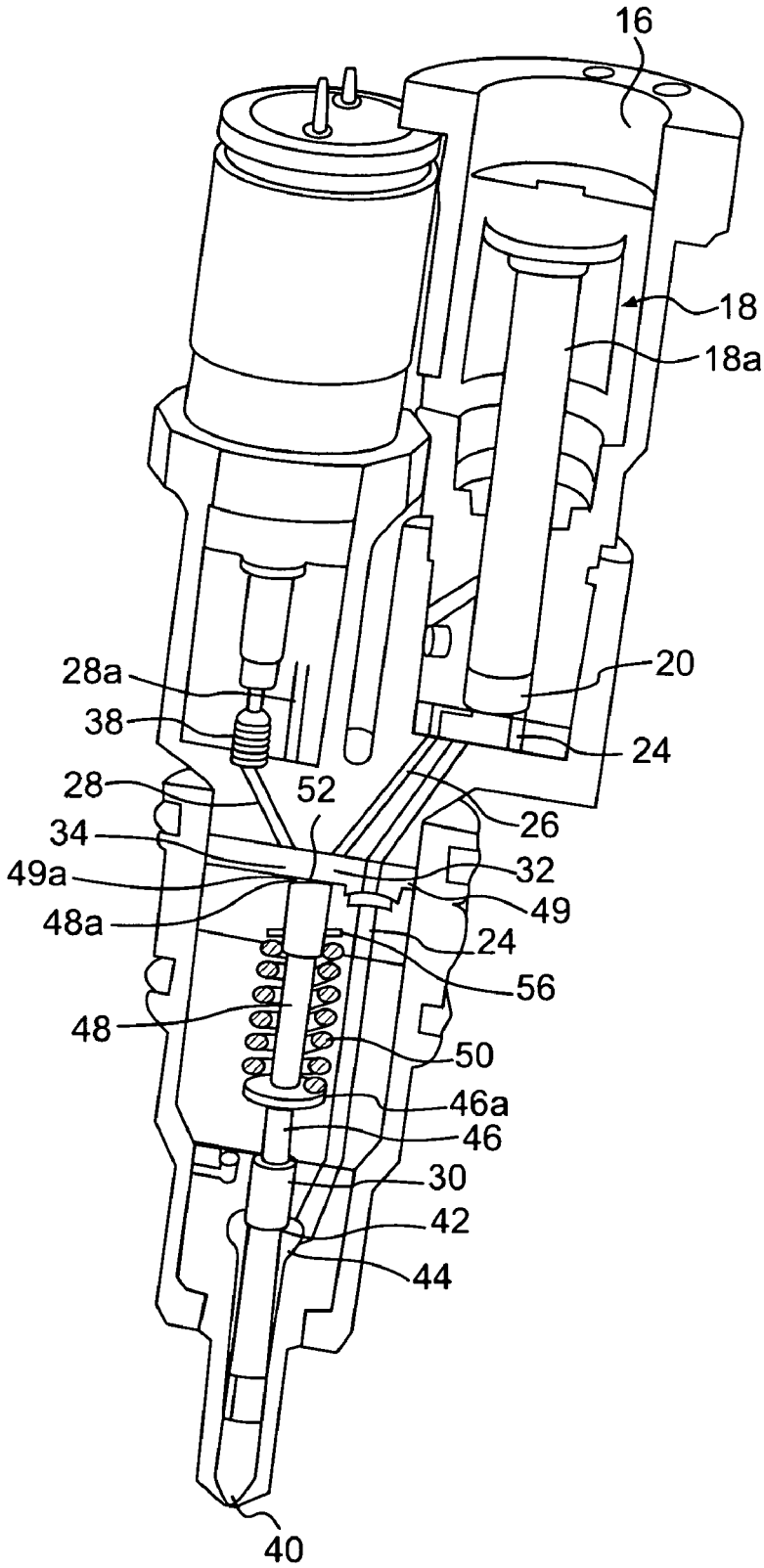
FIG. 4 shows a cross sectional view of an embodiment of the fuel injector of the invention.

FIG. 4 is a cross sectional view of the fuel injector of the invention. Specifically, the fuel injector 10 includes a hydraulic connection rail 16 in fluid communication with the low-pressure oil rail 12. Although not shown, the solenoid, $S_1$, controls the control valve 14 which may be situated in either the low-pressure rail 12 rail or the hydraulic connection rail 16. A piston and plunger assembly 18*a* is positioned within the intensifier chamber 18. The piston and plunger assembly 18*a* is in communication with the high-pressure fuel chamber 20 which is in fluid communication with the high-pressure fuel line 24. The high-pressure fuel line 24 extends to the nozzle assembly 30. The nozzle assembly 30 includes a needle 40 with an opening hydraulic surface 42 in fluid communication with the high-pressure fuel line 24. The needle preferable includes a hydraulic lifting surface with a 2 mm seat diameter and a 4 mm stem diameter. It should be recognized, though, that other diameters are also contemplated by the invention.

A heart or control chamber 44 surrounds the opening hydraulic surface 42 and is also in fluid communication with the high-pressure fuel line 24. A piston 46, which is part of the nozzle assembly 30, includes a piston surface 46*a*, preferably having a diameter of approximately 4 mm. A control piston 48 is mechanical coupled with the piston surface 46*a*. In embodiments, the control piston includes a closing hydraulic surface 48*a* which has a diameter of approximately 4.2 mm, for example, or larger than the diameter of the needle stem. A spring 50 surrounds the plunger 48 and is positioned between the piston surface 46*a* and a control disk 49.

Still referring to FIG. 4, the high pressure fuel line 24 is in fluid communication with the first fluid line 26 and the second fluid line 28 via the piston control chamber 52. In embodiments, a closing hydraulic surface 48*a* of the control piston 48 and a surrounding wall 49*a* of the control disk 49 forms the piston control chamber 52. A sealing member 56 is positioned about the control piston 48 in order to prevent leakage of fuel to the piston surface 46*a* and other parts of the injector. The first fluid line 26 and the second fluid line 28 are in fluid communication with the piston control chamber 52, and a drain or release line 28*a* is in fluid communication with the second line 28 on the opposing side of the valve 36. The solenoid $S_1$ activates the high pressure within the injector, i.e., (i) high pressure fuel line 24, (ii) the first fluid line 26, (iii) the second fluid line 28 and (iv) the piston control chamber 52. On the other hand, the drain line 28*a* allows the release of high-pressure fuel within the piston control chamber 52 upon the opening of the valve 36 (via the control of the piezoelectric actuator 38.) In embodiments, the diameter of the second throttle 34 is larger than the diameter of the first throttle 32.

The larger diameter of the second throttle 34, in combination with the actuation of the piezoelectric actuator 38 and opening of the valve 36, generates a pressure loss within the piston control chamber 52. This pressure loss decreases the downward forces applied on the closing hydraulic surface 48*a* of the control piston which, in combination with the high pressure in the high-pressure fuel line 24, allows the needle 40 to rise to begin an injection event. According to this configuration, when a voltage is applied to the piezoelectric actuator 38 and the valve 36 opens, the fuel will flow through the following flow path:

(i) from the piston control chamber 52;
(ii) through the larger diameter second throttle 34;
(iii) to the second fuel line 28;
(iv) through the valve 36;
(v) to the pressure release line 28*a*; and
(vi) into the fuel tank of low pressure diesel reservoir.

In this manner, the fuel pressure in the piston control chamber 52 can be decreased thus decreasing the forces exerted on the closing hydraulic surface 48*a* of the control piston 48. This creates a pressure differential between the piston control chamber 52 and the high-pressure fuel line 24; namely, the pressure within the high-pressure fuel line 24 will be greater than the pressure within the piston control chamber 52. In this manner, a force applied to the opening hydraulic surface 42 of the nozzle assembly will be greater than a force applied to the closing hydraulic surface 48*a* of the control piston 48. This action will then lift the needle in order to provide an injection event. By thus controlling the voltage applied to the piezoelectric actuator 38, the control of the injection event can be precisely controlled by the opening and closing of the valve 36 (i.e., the increase and decrease of pressure (forces applied to the hydraulic surfaces) within the piston control chamber 52). This can provide both pilot and post injection quantities of fuel, as well as multiple injections of fuel. Accurate rate shaping is also now possible through multiple injections with additional control valve measures on the oil side.

However, when no voltage is applied to the piezoelectric actuator 38, the pressure within the piston control chamber 52 and the high pressure fuel line 24 will approximately equalize. This is because the valve 36 is now closed and the pressure within the piston control chamber 52 will increase due to the pressure from the high-pressure fuel chamber 24. As a result, the force exerted on the closing hydraulic surface 48*a* of the control piston 48 in combination with the spring force will be greater than the force applied on the opening hydraulic surface 42 of the nozzle assembly 30 thus maintaining the needle 40 in the closed position.

Figure 5:
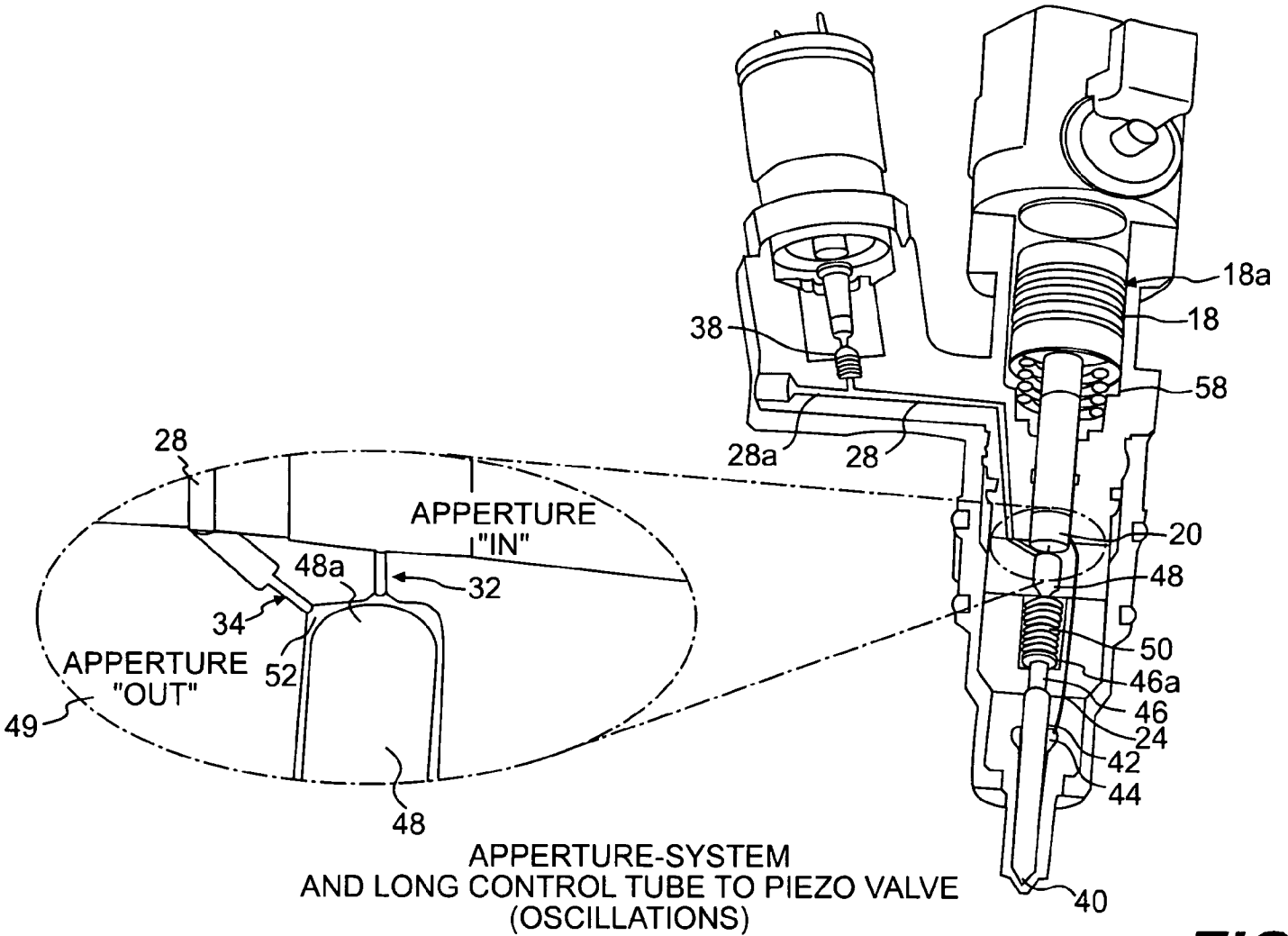
FIG. 5 shows a cross sectional view of an embodiment of the fuel injector of the invention.

FIG. 5 shows another embodiment of the invention using a long control tube 28 in fluid communication with the valve 36 and the piston control chamber 52. FIG. 5 also shows the diameter of the second throttle 34 being larger than the diameter of the first throttle 32. The piston control chamber 52 is also more clearly seen as comprising the hydraulic surface 48*a* of the control piston 48 and the walls of the disk. 49. The seal member 56 surrounds the control piston 48 to prevent leakage to the nozzle assembly 30. In the embodiment of FIG. 5, the flow control valve 14 is situated in the low-pressure oil rail 12; however, the flow control valve 14 can equally be situated in the hydraulic connection rail 16. Additionally, an optional spring 58 is provided within the intensifier chamber 18.

In one approach, the piezoelectric actuator 38 may be placed near the nozzle. In one embodiment, the piezoelectric actuator 38 is placed approximately 20 mm from the nozzle itself. The placement of the piezoelectric actuator 38 proximate to the nozzle may prevent or resolve the pre-opening of the needle. The placement of the piezoelectric actuator 38 near the nozzle may be accomplished by separating the intensifier chamber from the injector, and placing the piezoelectric actuator 38 at such location. The intensifier and valve system may be combined with the rail 14, with a short "pipe" connecting between the intensifier and valve system (pump) and the nozzle. The pipe would accommodate the piezoelectric actuator 38.

In a further embodiment, the opening of the hydraulic valve, providing working fluid to the intensifier chamber, may be slowed to provide a control strategy, i.e., to distribute the pressure equally to the back side of the needle and the needle tip. This will prevent or substantially decrease the pressure or shock wave phenomenon. In one embodiment the hydraulic valve may be slowed by 4 to 5 times the normal speed, which may be approximately between 300 to 1000 microseconds. This may be accomplished by providing less or a partial current, a step current to the solenoids or a hydraulic dampening. In one known application, solenoids are supplied with 20 amps at 50 volts. This will avoid early needle opening or a pre-injection. The working fluid may be coolant, oil, fuel or other hydraulic fluids.

Figure 6:
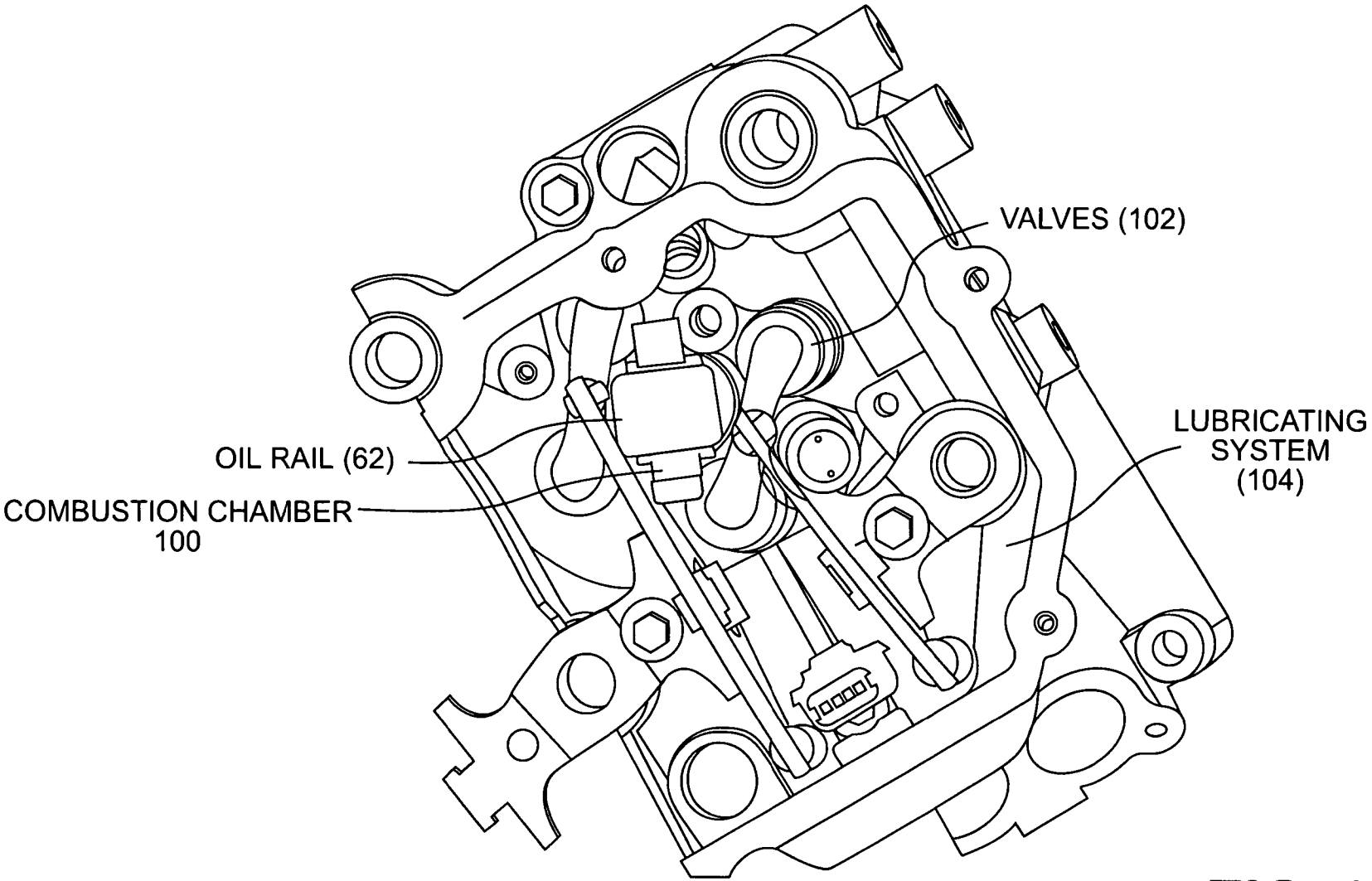
FIG. 6 shows the fuel injector in use with an internal combustion engine.

FIG. 6 shows the fuel injector 10 of the invention in use with an internal combustion engine. As seen in FIG. 6, the fuel injector is mechanically coupled to an oil rail 12 and is installed in a combustion chamber 100 of the internal combustion engine. The internal combustion engine includes valves (intake and exhaust) 102 and the like and is preferably a four stroke engine; however, a two stroke engine option is also contemplated for use with the invention. The engine also includes a lubricating system 104.

In Operation

In one embodiment of operation, low-pressure oil, fed by a hydraulic pump, is fed to the intensifier chamber via the hydraulic connection rail. In embodiments, the pressure control valve in either the injector or the low-pressure oil rail controls the high-pressure condition in the injector. It should be understood that the rail volume has to be high enough to provide the requisite energy required for the injection process.

To initiate the injection process, the control valve (or a single spring operated valve or a 2-way solenoid valve) moves from a closed position to the open position by, for example, an electromagnet controlled by the solenoid, $S_1$. This type of valve and the activation thereof is well known in the art and a description is thus omitted. It is understood, though, by keeping the valve in the open position requires less power than the initial opening. By opening the valve 14, the intensifier is activated to prepare the necessary high-pressure fuel for injection. Prior to this activation, fuel is allowed into the chamber 20 via the supply line 22 and valve 22*a*. It is seen in at least FIGS. 1 and 2, that the supply line 22 includes the one way valve 22*a* that will prevent any back flow to the fuel tank or other originating fuel source.

Now, by opening the valve 14, the oil will force the intensifier plunger and piston downward towards the high-pressure fuel chamber. Fuel will be forced through the high-pressure fuel line into the heart chamber as well as into the piston control chamber (via the first fluid line). Prior to activation of the piezoelectric actuator, the fuel pressure within the high-pressure fuel line and the piston control chamber will be substantially the same (after pressurization by the above mechanism). This will create a force on the hydraulic surface of the control piston in combination with the downward forces applied by the spring, which is greater than an upward force on the opening hydraulic surface of the nozzle assembly. In this way, the needle will be maintained in a closed position.

Although the injector is designed for multiple injections, the injection will be initiated through the activation of the piezoelectric actuator. In operation, a voltage is applied to the actuator 38 which, in turns, opens the control valve 36. Once open, a pressure loss will generate within the piston control chamber thus decreasing a force applied to the closing hydraulic surface. The high-pressure fuel in the high-pressure fuel line will flow to the control chamber and exert an upward force on the opening hydraulic surface greater than a downward force exerted by the spring and the force on the closing hydraulic surface of the control piston. The sealing member will ensure very low leakage to the nozzle assembly. The greater forces on the opening hydraulic surface of the nozzle assembly will then lift the needle to begin an injection event.

Depending on the opened amount of the valve (activated by the piezoelectric actuator), fuel pressure within the piston control chamber can be regulated thus regulating the force applied to the closing hydraulic surface of the control piston. In this manner, the needle opening distance can be regulated to provide a predetermined amount of fuel to the combustion chamber during an injection event. In other words, the loss of pressure (decrease of pressure via the larger diameter second throttle) within the piston control chamber will depend on the voltage applied to the actuator. Thus, the opening distance of the valve, which is controlled by the voltage applied to the actuator, will regulate the pressure losses within the piston control chamber. And, by regulating the pressure within the piston control chamber, the fuel pressure within the high pressure line can precisely facilitate and control the opening and closing of the needle. The high pressure is turned off when the last injection for the defined combustion cycle has taken place. The same process repeats at this point for the next cylinder by again reactivating the piezoelectric actuator.

While the invention has been described in terms of preferred embodiments, those skilled in the art will recognize that the invention can be practiced with modification within the spirit and scope of the appended claims.

Having thus described our invention, what we claim as new and desire to secure by Letters Patent is as follows:

1. A fuel injector, comprising:

an injector body defining a nozzle outlet and a high-pressure fuel chamber;

a needle valve member mounted in the injector body and having an opening hydraulic surface substantially surrounded by a high pressure fuel line which is in fluid communication with the high-pressure fuel chamber, the needle valve member being movable between an open position and a closed position with respect to the nozzle outlet;

a piezoelectric actuator being activated between an off position and an on position for positioning a control valve into one of an open position and a closed position;

a control piston having a closing hydraulic surface, the control piston being positioned in mechanical communication with the needle valve member;

a piston control chamber positioned between the control valve and the closing hydraulic surface of the control piston, the piston control chamber being in fluid communication with the control valve and the high-pressure fuel chamber via throttles; wherein a high-pressure fuel condition is maintained in the piston control chamber by fuel supplied directly from the high-pressure fuel chamber and independent of any actuation of the control valve, the high-pressure fuel condition results in a downward force acting on the closing hydraulic surface of the control piston, a pressure loss fuel condition is generated within the piston control chamber by activation of the piezoelectric actuator which moves the control valve to the open position for releasing fuel, and a force on the opening hydraulic surface of the needle valve member is greater than the downward force on the closing hydraulic surface of the control piston, in the pressure loss fuel condition, thereby opening the needle valve member for producing an injection event.

2. The fuel injector of claim 1, wherein the piezoelectric actuator is approximately 20 mm from the nozzle outlet.

3. The fuel injector of claim 2, wherein:

the needle has a first diameter, the piston surface has a second diameter, and the control piston has a third diameter at least as large as the sum of the first diameter and the second diameter.

4. The fuel injector of claim 1, further comprising a needle control spring exerting a downward force on the needle valve member.

5. The fuel injector of claim 4, wherein the downward force exerted by the needle control spring and the downward force on the closing hydraulic surface of the control piston is greater than a force exerted on the opening hydraulic surface of the needle valve member when the piezoelectric actuator is in the off position and the control valve is in the closed position.

6. The fuel injector of claim 4, wherein the downward force exerted by the control spring and the downward force on the closing hydraulic surface of the control piston is less than a force exerted on the opening hydraulic surface of the needle valve member when the piezoelectric actuator is in the on position and the control valve is thus moved into the open position.

7. The fuel injector of claim 1, wherein a placement of the piezoelectric actuator resolves pre-opening of the needle.

8. The fuel injector of claim 1, wherein:

the throttles are a first throttle having a first diameter and a second throttle having a second diameter larger than the first diameter, a first fuel line having the first throttle provides fluid communication between the high-pressure fuel line and the piston control chamber, and a second fuel line having the second throttle provides fluid communication between and the control valve and the piston control chamber.

9. The fuel injector of claim 8, wherein the control valve is positioned between the piston control chamber and the piezoelectric actuator.

10. The fuel injector of claim 9, further comprising a pressure release line on an opposing side of the control valve with respect to the piston control chamber, the pressure release line permitting fuel to drain from the piston control chamber when the control valve is in the open position.

11. The fuel injector of claim 1, further comprising:

a control disk partly defining the piston control chamber with the closing hydraulic surface of the control piston;

a first throttle of the throttles positioned within the control disk and having a first diameter and being in fluid communication with the piston control chamber and the high-pressure fuel line;

a second throttle of the throttles positioned within the control disk and having a second diameter larger than the first diameter and being in fluid communication with the piston control chamber and the control valve;

a first fuel line in fluid communication with the first throttle;

a second fuel line in fluid communication with the second throttle; and a pressure release fuel line positioned at an opposing side of the control valve with respect to the piston control chamber.

12. The fuel injector of claim 11, wherein:

the needle valve member includes a needle having a first diameter, the piston surface has a second diameter, and the control piston has a third diameter that is equal to or larger than the first diameter and the second diameter.

13. The fuel injector of claim 12, wherein the second diameter contributes to the pressure loss fuel condition in the piston control chamber when the control valve is in the open position.

14. The fuel injector of claim 1, further comprising a sealing member surrounding the control piston to prevent pressurized fuel from acting on a piston surface of the needle valve member.

15. The fuel injector of claim 1, wherein a pressure in the piston control chamber and the high-pressure fuel line is substantially equal when the control valve is in the closed position.

16. The fuel injector of claim 1, wherein the high pressure fuel condition is further maintained in the piston control chamber when the control valve is in the closed position;

the pressure loss fuel condition is generated by draining the fuel within the piston control chamber when the control valve is in the open position; and the high-pressure fuel condition is maintained in the high-pressure fuel line when the pressure loss fuel condition is generated in the piston control chamber.

17. The fuel injector of claim 1, further comprising a valve for providing fuel to the high-pressure fuel chamber independently controlled from the control valve.

18. The fuel injector of claim 1, wherein the control valve is driven by one of fuel, oil and working fluid.

19. The fuel injector of claim 18, further comprising a working fluid valve in fluid communication with an intensifier mechanism in the injector body, the working fluid valve being separately controlled by a control and the intensifier mechanism generating the high-pressure fuel condition in the high-pressure fuel chamber.

20. The fuel injector of claim 1, further comprising one of (i) a throttle positioned in the high-pressure fuel line to build-up pressure, (ii) a check valve placed between the high-pressure fuel chamber and a fuel line in fluid communication between the high-pressure fuel chamber and the piston control chamber, and (iii) a check valve positioned behind a fuel line positioned between the piston control chamber and the control valve in order to maintain pressure and volume in the high-pressure fuel line.

21. The fuel injector of claim 1, further comprising a delay valve positioned in the high-pressure fuel line to ensure a pressure build-up behind a nozzle of the needle valve member.

22. The fuel injector of claim 1, further comprising a spill bore associated with an intensifier mechanism used to delay pressurization in the high-pressure fuel line.

23. The fuel injector of claim 1, wherein the control valve is a two way control valve.

24. A fuel injector, comprising:

an injector body;

a control valve;

an intensifier mechanism positioned within the injector body and set in motion by actuation of the control valve;

a high-pressure fuel chamber located within the injector body which provides a high-pressure fuel condition in response to an activation of the intensifier mechanism;

an independently controlled hydraulically actuated fuel supply valve for supplying fuel to the high-pressure fuel chamber;

a high-pressure supply line in fluid communication with the high-pressure fuel chamber;

a needle valve member mounted in the injector body and having an opening hydraulic surface surrounded at least partially by the high-pressure fuel line;

a controllable valve;

a piezoelectric actuator mounted in the injector body and independently controlled to be moved between an off position and an on position for controlling movement of the controllable valve between an open position and a closed position;

a control piston having a closing hydraulic surface, the control piston being mechanically coupled to the needle valve member; and a piston control chamber in fluid communication with the high-pressure fuel line and defined by an upper end of the control piston and an interior wall of the injector body.

25. The fuel injector of claim 24, wherein a high-pressure fuel condition is maintained in the piston control chamber by pressurized fuel received directly from the high-pressure fuel chamber and independent of an initial actuation of the piezoelectric actuator.

26. The fuel injector of claim 25, further comprising:

a control spring surrounding the control piston and exerting a downward force on the needle valve member, wherein the downward force exerted by the control spring and the downward force exerted on the closing hydraulic surface of the control piston during the high-pressure fuel condition is greater than a force exerted on the opening hydraulic surface of the needle valve member provided by the high-pressure fuel condition in the high-pressure fuel line.

27. The fuel injector of claim 24, wherein a downward force generated by the high-pressure fuel condition acts on the closing hydraulic surface of the control piston to maintain the needle valve member in a closed position.

28. The fuel injector of claim 24, wherein the needle valve member includes a needle and an opposing piston surface, the opposing piston surface being in mechanical communication with the control piston on an opposing side to the closing hydraulic surface.

29. The fuel injector of claim 24, wherein a fuel pressure loss condition is generated when the controllable valve is opened upon the actuation of the piezoelectric actuator.

30. The fuel injector of claim 29, further comprising:

a control spring surrounding the control piston or a needle stem and exerting a downward force on the needle valve member, wherein the downward force exerted by the control spring and the downward force exerted on the closing hydraulic surface of the control piston during the fuel pressure loss condition is less than a force exerted on the opening hydraulic surface of the needle valve member provided by a high-pressure fuel condition in the high-pressure fuel line.

31. The fuel injector of claim 24, wherein the controllable valve is one of a pressure release valve and a servo valve.

32. The fuel injector of claim 24, further comprising:

a first fuel line having a throttle with a first diameter in fluid communication with the piston control chamber and the high-pressure fuel line; and a second fuel line having a throttle having a second diameter larger than the first diameter and in fluid communication with the pressure release valve and the piston control chamber.

33. The fuel injector of claim 24, further comprising a pressure release line on an opposing side of the pressure release valve with respect to the piston control chamber, the pressure release line permitting drainage of the fuel during the pressure loss fuel condition when the pressure release valve is in the open position.

34. The fuel injector of claim 24, further comprising:

a control disk partly defining the piston control chamber with the closing hydraulic surface of the control piston;

a first throttle positioned within the control disk and having a first diameter and being in fluid communication with the piston control chamber and the high-pressure fuel line;

a second throttle positioned within the control disk and having a second diameter larger than the first diameter and being in fluid communication with the piston control chamber;

a first fuel line in fluid communication with the first throttle and the high-pressure fuel line;

a second fuel line in fluid communication with the second throttle and the pressure release valve; and a pressure release fuel line positioned at an opposing side of the control valve with respect to the piston control chamber.

35. The fuel injector of claim 24, wherein a pressure in the piston control chamber and the high-pressure line is substantially equal when the pressure release valve is in the closed position.

36. The fuel injector of claim 24, wherein a high pressure fuel condition is maintained in the piston control chamber when the pressure release valve is in the closed position and high-pressure fuel is supplied from the high-pressure control chamber; and a pressure loss fuel condition is generated in the piston control chamber when the pressure release valve is in the open position thereby allowing the high-pressure fuel to drain from the piston control chamber to a pressure release line.

37. The fuel injector of claim 24, wherein the hydraulically actuated fuel supply valve is a one way valve which works independently of the pressure release valve.

38. The fuel injector of claim 24, wherein the control valve, in a first position, provides working fluid to the intensifier mechanism in order to generate the high-pressure fuel condition in the high-pressure fuel line and the piston control chamber.

39. The fuel injector of claim 24, further comprising one of (i) a throttle positioned in the high-pressure fuel line to build-up pressure in a first fuel line positioned between the piston control chamber and the pressure release valve, (ii) a check valve placed between the high-pressure fuel chamber and a second fuel line positioned between the piston control chamber and the high-pressure fuel chamber, and (iii) a check valve positioned behind the first fuel line in order to maintain pressure and volume in the high-pressure fuel line.

40. The fuel injector of claim 24, further comprising a delay valve in the high-pressure fuel line to ensure a pressure build-up behind a nozzle of the needle valve member.

41. The fuel injector of claim 24, further comprising a spill bore associated with the intensifier mechanism used to delay pressurization in the high-pressure fuel line.

42. A fuel injector, comprising:

an injector body having a high-pressure fuel chamber and a needle valve member with a hydraulic surface;

a high-pressure fuel line in fluid communication with the high-pressure fuel chamber and at least partially surrounding the hydraulic surface of the needle valve member;

a control chamber in direct fluid communication with the high-pressure fuel chamber;

a controllable valve for generating a high-pressure fuel condition in the high-pressure fuel chamber, the high-pressure fuel line and the control chamber;

a needle valve member mounted in the injector body and having an opening hydraulic surface at least partially surrounded by the high-pressure fuel line;

an electrically actuated controller;

a piezoelectric actuator mounted in the injector body and being actuated between an off position and an on position by actuation of the electrically actuated controller;

a pressure release valve positionable in an open position and a closed position by actuation of the piezoelectric actuator;

a first fuel line in fluid communication with the control chamber and the high-pressure fuel chamber, the first fuel line having a first diameter; and a second fuel line in fluid communication with the pressure release valve and the control chamber and having a second diameter which is larger than the first diameter of the first fuel line, wherein a high-pressure fuel condition is maintained in the control chamber by a fuel pressure which is generated in the high-pressure fuel chamber and independent of an initial actuation of the electronically actuated control, and a low-pressure fuel condition is generated within the control chamber when the pressure release valve is in the open position.

43. The fuel injector of claim 42, wherein the control piston has a closing hydraulic surface positioned within the control chamber.

44. The fuel injector of claim 43, further comprising:

a control piston in mechanical communication with the piston surface of the needle valve member, wherein the high-pressure fuel condition is regulated partly by the piezoelectric actuator and a downward force acts on the closing hydraulic surface of the control piston such that the needle valve member is maintained in a closed position.

45. The fuel injector of claim 44, further comprising:

a control spring surrounding the control piston or a stem of the needle valve member and exerting a downward force on the needle valve member, wherein the downward force exerted by the control spring and the downward force on the closing hydraulic surface of the control piston is greater than a force exerted on the opening hydraulic surface of the needle valve member when the pressure release valve is in the open position thus allowing fuel to drain from the control chamber.

46. The fuel injector of claim 44, further comprising:

a control spring surrounding the control piston or a stem of the needle valve member and exerting a downward force on the needle valve member, wherein the downward force exerted by the control spring and the downward force on the closing hydraulic surface of the control piston is less than a force exerted on the opening hydraulic surface of the needle valve member when the pressure release valve is in the closed position.

47. The fuel injector of claim 42, wherein the first diameter is provided by a first throttle and the second diameter is provided by a second throttle.

48. The fuel injector of claim 42, further comprising a pressure release line on an opposing side of the control valve with respect to the control chamber, the pressure release line permitting draining of the fuel resulting in a pressure loss fuel condition in the control chamber when the pressure release valve is in the open condition for needle opening operations.

49. The fuel injector of claim 48, further comprising a control disk, wherein the control chamber is partly defined by the control disk, and the first fuel line, the second fuel line, the high-pressure fuel line, and the pressure release fuel line is at least partially defined by the control disk.

50. The fuel injector of claim 42, wherein the controllable valve is one of a hydraulically actuated valve, a servo valve and an independently controlled one way hydraulically actuated valve.

51. The fuel injector of claim 42, further comprising one of (i) a throttle positioned in the high-pressure fuel line to build-up pressure in the second fuel line positioned between the control chamber and the pressure release valve, (ii) a check valve placed between the high-pressure fuel chamber and a the first fuel line, and (iii) a check valve positioned behind the second fuel line in order to maintain pressure and volume in the high-pressure fuel line.

52. The fuel injector of claim 42, further comprising a delay valve in the high-pressure fuel line to ensure a pressure build-up behind a nozzle of the needle valve member.

53. The fuel injector of claim 42, further comprising a spill bore associated with the intensifier mechanism used to delay pressurization in the high-pressure fuel line.

54. An internal combustion engine, comprising:

a combustion chamber having intake and exhaust valves;

a lubrication system for lubricating components associated with the combustion chamber;

a rail line; and a fuel injector communicating with the combustion chamber, the fuel injector comprising:

an injector body having an intensifier chamber in fluid communication with the rail line;

an intensifier piston movable within the intensifier chamber;

a high-pressure fuel chamber defined partially by an end of the intensifier piston;

an independently controllable hydraulic valve for supplying fuel to the high-pressure fuel chamber;

a high-pressure fuel line in fluid communication with the high-pressure fuel chamber;

a needle valve member having a hydraulic surface at least partially surrounded by the high-pressure fuel line;

a control chamber;

a first fuel line fluidly coupled between the high-pressure chamber and the control chamber;

an independently hydraulically actuated valve for controlling the intensifier piston;

an independently electrically actuated controller;

a piezoelectric actuator mounted in the injector body and being activated between an off position and an on position by actuation of the electrically actuated controller;

a pressure release valve positionable in an open position and a closed position by actuation of the piezoelectric actuator; and a second fuel line fluidly coupled between the pressure release valve and the control chamber, wherein a high-pressure fuel condition is provided in the control chamber independently by a fuel pressure which is generated in the high-pressure fuel chamber, and a low-pressure fuel condition is generated within the control chamber when the pressure release valve is in the open position.

55. The engine of claim 54, wherein:

the first fuel line has a first diameter; and the second fuel line has a second diameter which is larger than the first diameter.

56. The engine of claim 54, wherein the independently controllable hydraulic valve is a one way valve.

57. The engine of claim 54, wherein the pressure release valve is a two way valve.

58. The engine of claim 54, further comprising a valve located in the rail line to supply working fluid to the intensifier chamber when in a first state.

59. The engine of claim 54, further comprising:

a hydraulic line fluidly coupled between the rail line and the intensifier chamber; and a valve located in the hydraulic line to supply working fluid to the intensifier chamber when in a first state.

60. A method of controlling fuel injection events of a fuel injector, comprising the steps of:

hydraulically actuating a valve to provide low pressure fuel to a high-pressure fuel chamber;

hydraulically actuating a valve to provide working fluid to an intensifier chamber to act on an intensifier piston;

generating a high-pressure fuel condition upon actuation of the valve in the high-pressure fuel chamber; and independently activating a pressure release valve to drain fuel in the control chamber to create a low pressure condition in a control chamber fluidly coupled to the high-pressure fuel chamber, wherein the low pressure fuel condition in the control chamber creates a pressure differential in the control chamber and a high-pressure fuel line, fluidly coupled to the high-pressure fuel chamber, such that fuel in the high-pressure fuel line exerts an upward force on a hydraulic surface of a needle to raise the needle to begin an injection event.

61. The method of claim 60, wherein the high-pressure fuel condition generated in the control chamber is independent of an initial movement of the two way pressure release valve.

62. The fuel injector of claim 21, wherein the delay valve includes:

an upper portion having a landing;

a lower telescoping portion having a timing throttle;

a chamber formed between the upper and lower portion;

a spring positioned within the chamber; and a groove positioned in relation to the landing in an open state of the delay valve, wherein, in the open state, the landing is positionable with relation to the groove providing a communication path between the high-pressure fuel line and the high-pressure fuel chamber and generating a delay, and wherein, in the closed state, the landing is positionable away from the groove preventing fluid communication between the high pressure fuel line and the high-pressure fuel chamber.

63. The fuel injector of claim 62, wherein the timing throttle provides fuel communication between chamber and the high-pressure fuel line, and allows fuel to accumulate in the chamber when the delay valve is in the closed state.

64. The fuel injector of claim 22, wherein the spill bore is in communication with a groove of the intensifier mechanism, the groove being in communication with an inlet port of the high-pressure fuel during an activation of the intensifier mechanism.

65. The fuel injector of claim 1, wherein a placement of the piezoelectric actuator substantially reduces a pressure wave generated in the fuel.

66. The fuel injector of claim 65, wherein the piezoelectric actuator is placed at approximately 20 mm away from the nozzle outlet.

67. The method of claim 60, wherein the step of hydraulically actuating a valve provides a substantially even pressure distribution of fuel to a back side of the needle and a needle tip.

68. The method of claim 67, wherein the substantially even pressure distribution of the fuel substantially decreases a shock wave phenomenon in the fuel to avoid a pre-injection event.

69. The method of claim 67, wherein the even pressure distribution is accomplished by providing a less or partial current or a step current to solenoids controlling the movement of the valve which provides working fluid to the intensifier chamber.

70. The method of claim 67, further comprising providing a hydraulic dampening to provide the even pressure distribution.

* * * * *